US008994515B2

(12) United States Patent
Guyon et al.

(10) Patent No.: US 8,994,515 B2
(45) Date of Patent: Mar. 31, 2015

(54) SYSTEM FOR PROGRAMMING AND LIGHTING ELECTRONIC DETONATORS AND ASSOCIATED METHOD

(75) Inventors: Franck Guyon, Auxerre (FR); Raphael Trousselle, Auxerre (FR)

(73) Assignee: Davey Bickford, Hery (FR)

( * ) Notice: Subject to any disclaimer, the term of this patent is extended or adjusted under 35 U.S.C. 154(b) by 172 days.

(21) Appl. No.: 13/575,715

(22) PCT Filed: Jan. 28, 2011

(86) PCT No.: PCT/FR2011/050176

§ 371 (c)(1),
(2), (4) Date: Jul. 27, 2012

(87) PCT Pub. No.: WO2011/095730

PCT Pub. Date: Aug. 11, 2011

(65) Prior Publication Data

US 2012/0299708 A1 Nov. 29, 2012

(30) Foreign Application Priority Data

Feb. 2, 2010 (FR) ..... 10 50717

(51) Int. Cl.
*H04Q 5/22* (2006.01)
*F42D 1/05* (2006.01)
*F42D 1/055* (2006.01)
(Continued)

(52) U.S. Cl.
CPC . *F42D 1/05* (2013.01); *F42D 1/055* (2013.01)
USPC ..... 340/10.52; 102/215; 102/311

(58) Field of Classification Search
USPC ..... 340/10.1–10.52; 102/215, 311
See application file for complete search history.

(56) References Cited

U.S. PATENT DOCUMENTS 6,173,651 B1 * 1/2001 Pathe et al. ..... 102/218
6,644,202 B1 * 11/2003 Duniam et al. ..... 102/312
(Continued)

FOREIGN PATENT DOCUMENTS

MX 2009006648 A 8/2009
WO 97/45696 A1 12/1997
(Continued)

OTHER PUBLICATIONS

International Search Report, dated May 4, 2011, from corresponding PCT application.

*Primary Examiner* — Jennifer Mehmood
*Assistant Examiner* — Omar Casillashernandez
(74) *Attorney, Agent, or Firm* — Young & Thompson

(57) ABSTRACT

A system for programming and lighting electronic detonators (1) each having an identifier ($ID_{det}$) associated therewith, includes: a programming unit (20) arranged to determine the identifiers of the detonators (1) and to associate the detonators individually, in memory, with a lighting time delay ($T_{det}$) in order to form a blasting pattern (PT); a blasting unit (10) arranged to recover the blasting pattern (PT) from the memory (280) of the programming unit (20), and to control a blasting sequence of the detonators according to the recovered blasting pattern; and the programming unit (20) includes: a passive RFID tag (28) provided with a chip (280) acting as a memory for storing the blasting pattern (PT), and a radiofrequency reader (27) arranged such as to read/write passive tags. A corresponding method is also described.

13 Claims, 3 Drawing Sheets

(51) Int. Cl.
*F23Q 7/02* (2006.01)
*F42B 3/00* (2006.01)

(56) References Cited

U.S. PATENT DOCUMENTS 6,941,870 B2 * 9/2005 McClure et al. ..... 102/311
7,086,334 B2 * 8/2006 Jennings, III ..... 102/206
8,256,349 B2 9/2012 Moore
2001/0054366 A1 * 12/2001 Hutchins et al. ..... 102/335
2007/0180207 A1 8/2007 Garfinkle
2009/0145321 A1 * 6/2009 Russell ..... 102/215
2010/0214080 A1 * 8/2010 Alexis ..... 340/10.51
2011/0101996 A1 * 5/2011 Potyrailo ..... 324/655

FOREIGN PATENT DOCUMENTS

WO 2006/076777 A1 7/2006
WO 2008/074071 A1 6/2008

* cited by examiner

SYSTEM FOR PROGRAMMING AND LIGHTING ELECTRONIC DETONATORS AND ASSOCIATED METHOD

The present invention relates to a system for programming and firing a set of electronic detonators, as well as to a corresponding programming method.

BACKGROUND OF THE INVENTION

In most works with explosives, the detonation of charges associated with detonators is triggered according to a very precise time sequence, this being so in order to improve the efficiency of the work of the explosive and to better control the effects thereof. The recent appearance of electronic detonator firing systems has made it possible to obtain much greater precision of this time sequence than the precision of conventional pyrotechnic systems.

When implementing electronic detonator firing systems, a significant job of work consists in preparing the firing plan for the detonators corresponding to this time sequence, and then in programming and testing these detonators "at the front", that is to say in proximity to the blast holes, and then in firing the detonators from a "firing post", that is to say at a safety distance from the firing zone.

Publication WO 97/45696 describes steps of programming detonators consisting mainly in using one or more programming consoles or units to associate a delay time, in milliseconds, with each of the detonators. The corresponding association table forms a firing plan which is subsequently transferred to a firing console or unit possessing the capabilities and codes for firing the detonators.

This transfer may be carried out by virtue of infrared technology, the latter requiring precise relative positioning of the two units, thereby rendering it difficult to implement in a works environment or worksite.

Other firing systems propose a transfer of these data between the programming console or consoles and the firing console with the aid of linking cables or else with the aid of wireless technologies of Bluetooth type (commercial name). In the first case, it may happen that the cable fails or is mislaid thereby making it impossible to retrieve the data from the programming consoles.

Finally, the technologies used today, be they wire-based or wireless using infrared or Bluetooth, require an electrical power supply to ensure the transfer of data.

There is therefore a need to secure this transfer of data to the firing console using neither cables nor electrical power supply of the console from which it is desired to retrieve the data.

In practice, an operator traverses up and down the works site so as to connect each of the detonators successively and individually to a firing line. The operator's programming unit also being connected to the firing line, it detects the connection of a new detonator and identifies the latter. The operator then inputs, using an alphanumeric keypad of the programming console, a delay time to be associated with each of the successively identified detonators on the firing line.

For the subsequent description, this operation will be referred to as "programming the detonators".

As a variant, instead of associating a firing cue of delay time type with each detonator, the operator can specify, on his programming unit, a firing cue of drill-hole identifier type on the site in which the detected detonator is placed, the association with a delay time possibly being carried out subsequently on the firing console for example.

During the operation of programming the detonators, a step of identifying the detonators is carried out. This identification consists, in respect of the programming unit, in retrieving a parameter for identifying the detonator connected by exchanging messages on the firing line, this parameter being for example stored in ROM memory of the electronic detonator. The programming unit then stores, in EEPROM memory, the association carried out between this identification parameter and the corresponding delay time or hole number that was input. The resulting table constitutes the firing plan.

As a variant, the identification can consist, in respect of the programming unit, in dispatching to the detonator an identification parameter which will be stored by the detonator, for example in EEPROM memory, the programming unit then storing the association of this identifier and of the firing cue of delay time or hole number type.

When firing sizable shots, this programming operation can rapidly become laborious having regard mainly to the sizable number of detonators to be connected and programmed. Thus, several hours of programming may sometimes be necessary. In this case, the programming operation may be carried out by several operators, each being equipped with a programming console so as to program, with each console, part of the firing plan. In practice, the firing plan is divided up into several zones, the detonators of each of them being connected to bus lines, these bus lines together constituting a network connected to a main line called the firing line. In this configuration, it is commonplace to use one and the same programming console for the programming of one or more bus lines and not to mix on one and the same bus line detonators programmed by different programming units.

Once the programming of all the detonators has been performed, it is moreover commonplace to undertake tests on site with the aid of the programming console(s). These tests are in particular intended to verify that all the programmed detonators are properly linked to the firing line and that no other "intruder" detonator has been connected without having been previously programmed by a programming console.

When several programming consoles have been used for the programming of a firing, each of them contains the identification parameters for only some of the detonators present on the firing line, corresponding only to the detonators programmed by this console. Each console undertakes functions of counting and then of identifying the connected detonators. However, there is reason not to consider the detonators programmed by the other consoles to be intruders. This necessitates mental intervention by the operators so as in particular to compare the number of detonators connected with the number of detonators programmed, without making it possible to easily detect any intruders.

Excluding the case where a single programming console has been used, no programming console contains all the identifiers of the detonators of the firing plan. It is then impossible to test the whole of the firing plan at once.

There is therefore also a need for means which simplify the test operations to be conducted on the firing lines or sets.

Moreover, it may happen that a programming unit undergoes a failure during these programming operations, for example because of a power supply battery fault or of hardware destruction resulting from a worksite accident. Such a situation compels complete reprogramming of the detonators initially stored in the (partial) firing plan of the failed console. A considerable loss of time can thus be caused. It may also happen that the operator cannot terminate his programming operations since the battery is flat and requires recharging.

There is also a need for more effective programming means, in particular in the case of failure of a programming console.

SUMMARY OF THE INVENTION

In this context, the invention is aimed at solving at least one drawback of the prior art by proposing in particular to simplify the transfer of data, including the programmed firing plans, between various consoles.

For this purpose, the invention relates in particular to a system for programming and firing a plurality of electronic detonators with each of which is associated an inherent identification parameter, the system comprising:

- at least one programming unit comprising a memory and designed to determine the identification parameters for electronic detonators and to associate with them individually, in memory, a firing cue, so as to form a firing plan;
- a firing unit designed to retrieve, from the memory of the at least one programming unit, said firing plan made of the associations between the identification parameters and the corresponding firing cues, and to command a firing sequence for the detonators on the basis of the firing plan retrieved;

characterized in that at least one programming unit comprises:

- a passive tag with radiofrequency reading/writing fitted with a chip operating as memory for the storage of the firing plan, and
- a radiofrequency reader designed to read and write passive tags, including said passive tag of the programming unit.

The system according to the invention relies on RFID tags to store the firing plans undergoing programming on site or "at the front". The expressions "on site" or "at the front" are understood to mean the operations carried out on the works site where the detonators are implanted. This expression is in contrast to actual firing, which is carried out at a distance through the firing line by a firing console, also termed detonation console. As a variant, a "master" firing console can optionally command several different firings by means of local "slave" firing consoles each linked to a particular firing line.

In contradistinction to the EEPROM memories used in the solutions of the prior art, requiring a power supply to access same, the use of RFID tags makes it possible, despite the hostility of the works site to computerized manipulations, to simplify and secure the transfer of these firing plans to other consoles, even though the originating programming console may have failed.

By transferring a partial firing plan to a new programming console by virtue of the RFID means, it is possible to continue the programming of the firing plan without losing what was done prior to the failure of the first console.

Furthermore, during the tests conducted following the programming of the firing plan by several consoles, the invention also simplifies the transfer of the programmings onto a lone console. The tests conducted with the aid of this lone console allow easier identification of intruder detonators and reduce or indeed dispense with the mental intervention of the operator.

It is observed, moreover, that in contradistinction to the conventional uses of passive tags of RFID type with the aim of radiofrequency identification, the passive tag according to the invention operates, mainly, in the guise of data memory decorrelated from any identification of the programming console which contains it. Here, the purpose of the stored firing plan is not to identify the programming console.

This emerges clearly from the description detailed hereinafter in which this passive tag appears as temporary memory of the firing plans before transfer either to another programming console, or generally to the firing console.

In one embodiment, a first programming unit comprises means for commanding said radiofrequency reader which are designed to read the firing plan in memory of the passive tag of a second programming unit and to copy said read firing plan into the memory of the passive tag of the first programming unit.

This provision makes it possible to ensure simple and effective retrieval of firing plans partially programmed by a programming unit that has failed.

In particular, said passive tag comprises, associated with said firing plan, an identification datum for a geographical zone to which said detonators forming the firing plan belong. In particular, since a programming console is generally used on a single firing line or a bus line, this may involve the identification of this line, for example via an identifier of a local slave firing console attached to this line.

This simplifies in particular the groupings of firing plans with a view to the tests and/or with a view to powering the firing consoles.

In one embodiment of the invention, said firing unit comprises a radiofrequency reader designed to read and write the passive tag of the at least one programming unit so as to retrieve said firing plan.

By virtue of this configuration, the retrieval of the firing plan from the programming console or consoles is rendered easier as compared for example with the infrared techniques of the prior art.

In particular, said programming unit comprises means for disabling its radiofrequency reader when an external radiofrequency reader transfers the firing plan from the memory of this programming unit.

Conflicts of reading of the radiofrequency tags by two competing readers are thus avoided. This applies in particular when the firing console retrieves the firing plans of the whole set of programming consoles, but also when it is desired to concentrate the set of firing plans input on a single programming console for the purpose, for example, of conducting tests via this console alone.

According to a characteristic of the invention, said firing cues comprise a firing time delay for the corresponding detonator. The firing plan thus obtained is directly operational for the firing consoles. In particular, said identification parameters are coded on 24 bits and said time delays are coded on 14 bits.

This configuration makes it possible to store, in table form, a firing plan composed of several thousand entries on conventional radiofrequency tags, for example furnished with 32 kb (kilo-bytes) of memory.

In one embodiment, the at least one programming unit comprises a plurality of radiofrequency tags, each for storing a part of the firing plan. By virtue of radiofrequency reading anti-collision techniques, the advantages of the present invention are retained while extending the programming capabilities of the associated units.

In another embodiment, the radiofrequency tag is removable. It can thus be inserted into another programming unit to carry on with the programming operations.

Correlatively, the invention also relates to a programming method for the firing of a plurality of electronic detonators with each of which is associated an inherent identification parameter, the method comprising:

a step of determination, by at least one programming unit comprising a memory, of identification parameters for electronic detonators;

a step of association, in memory of the programming unit, of a firing cue with each determined identification parameter, so as to form a firing plan;

a step of acquisition, by a firing unit able to command a firing sequence for the detonators, from the memory of the at least one programming unit, of said firing plan made of the associations between the identification parameters and the corresponding firing cues;

characterized in that the association step comprises a writing by radiofrequency of said association, into the memory of a passive tag with radiofrequency reading/writing.

The method exhibits advantages similar to those of the system set forth hereinabove, in particular easy availability of the firing plan for other consoles.

In an optional manner, the method can comprise steps pertaining to the characteristics of the previously set forth programming and firing system.

In particular, the method also comprises a step of transfer by radiofrequency reading of the firing plan from the passive tag of a first programming unit to the memory of the passive tag of a second programming unit. This transfer can in particular be effected upon the failure of said first programming unit or when it is desired to group together, on site, the firing plans of several programming consoles, for example to conduct tests on the entirety of the detonators.

According to a particular characteristic, said second programming unit carries on with the acquisition and association steps so as to complete the transferred firing plan. By virtue of this provision, the beginning of programming of the firing plan is not lost in the case of failure of a first programming unit. Moreover provision is made to carry on, with the aid of a second programming unit, for example a backup unit, with the programming of the detonators by completing the firing plan retrieved from the failed console.

In one embodiment, the plurality of electronic detonators is distributed in several distinct geographical zones, and the method comprises a step of reading and associating an identifier of a so-called geographical zone with said firing plan in memory. This step can in particular consist in reading an RFID tag contained in a slave firing console linked to the firing line to which the detonators of said geographical zone are connected.

BRIEF DESCRIPTION OF THE DRAWINGS

Other particular features and advantages of the invention will further appear in the description hereinafter, illustrated by the appended drawings, in which.

DETAILED DESCRIPTION OF THE PREFERRED EMBODIMENTS

Figure 1:
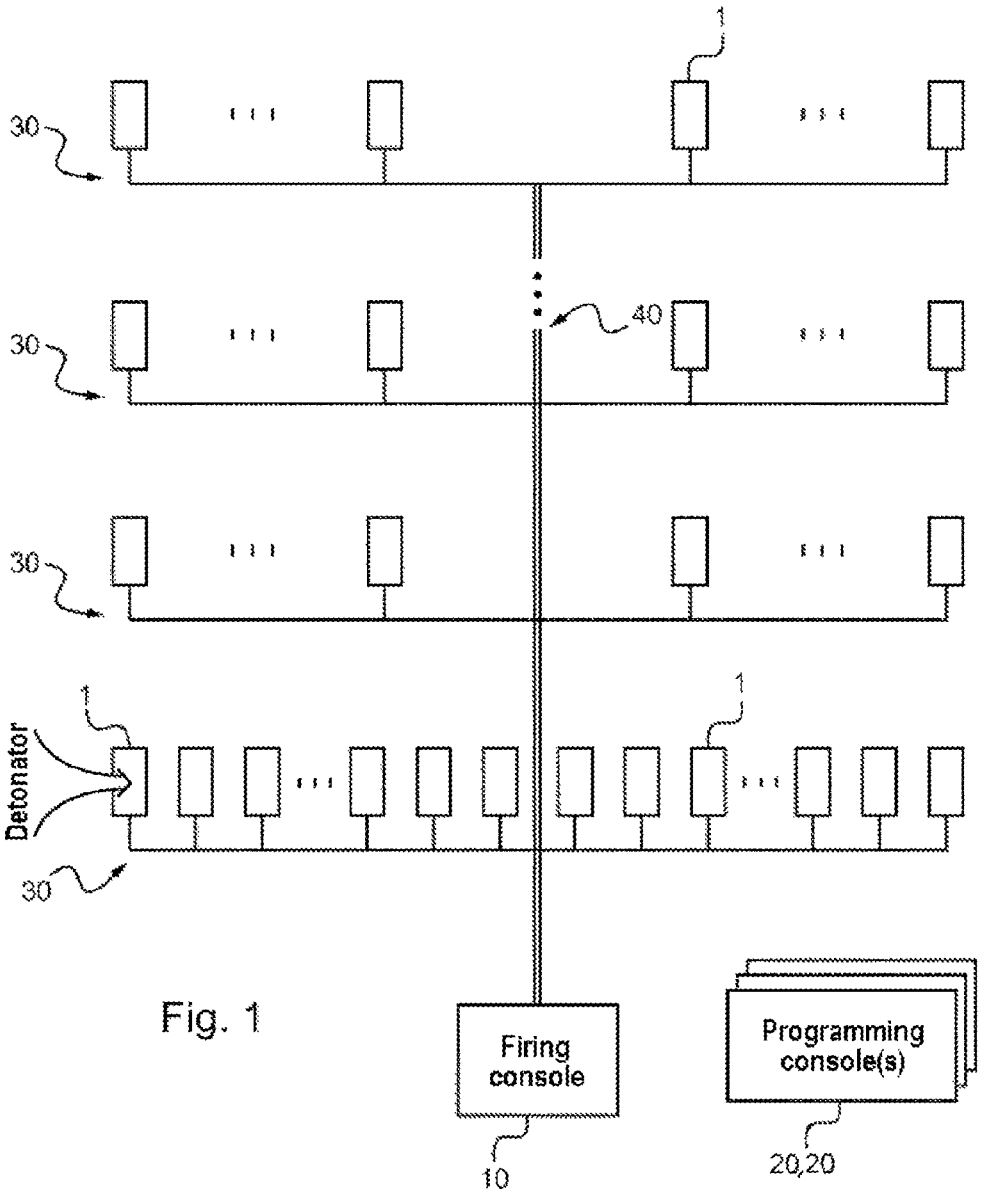
FIG. 1 represents the general organization of a firing set for the implementation of the invention.

As represented in FIG. 1, a firing set may be constituted on the basis of detonators 1 similar to those presented in publication WO 97/45696. This firing set, also visible in FIGS. 2B and 2C, comprises an arbitrary number of electronic detonators 1 connected to bus lines 30, themselves linked to a firing line 40 which is in its turn linked with a remote firing control unit 10, also called a "firing console" or "detonation console".

In order to reduce the wiring required to link the remote firing control unit to the network, provision may be made for one and the same remote firing control unit, termed the "master", which dispatches, by radio, control instructions to a plurality of local firing control units, termed "slaves", each linked for example to a firing line 40.

The detonators 1 may be used in sizable numbers in a parallel layout, up to even more than 1000.

The detonators 1 are fitted with a ROM read-only memory storing a unique identifier $ID_{det}$ of the detonator on 24 bits for example. Any other combination of parameters for identifying the detonators, such as that mentioned in publication WO 97/45696, may be envisaged.

The detonators are able to dialog with the firing console 10 (or the slave consoles), which can transmit orders to them and receive cues from them.

The firing set also comprises one or more programming units 20, also called "programming consoles". The latter are intended to identify each of the electronic detonators 1 before or after they are put in place in a hole drilled on the site, and to progressively construct cues about firing sequences or a "firing plan", during this identification. They are also used to transfer these firing plan cues to the firing console 10.

Three configurations may be envisaged for the connections between detonators 1, firing console 10, and programming console 20.

Figure 2A:
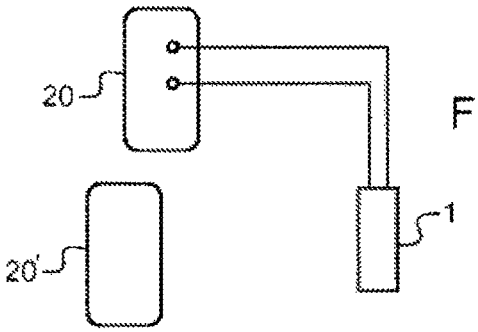
FIGS. 2A, 2B and 2C are schematic representations of a firing set comprising detonators mounted in parallel, revealing communication circuits established respectively during the programming of a detonator, the transfer of cues from the programming unit to the firing control unit and during a sequence for firing a volley of detonators.

In a first configuration, represented in FIG. 2A, the programming console 20 is connected successively to each of the detonators 1. This first configuration corresponds to a first step, during which an operator on site "programs" the firing plan by successively associating each connected detonator (and its identifier) with a corresponding delay time at the level of the programming console 20. As will be seen subsequently, these associations are stored using a table in memory of the programming console 20.

As a variant, this connection can consist in connecting the programming console 20 to a bus line 30 and then in detecting, via messages exchanged, each new detonator 1 connected to this same line, the dispatching of a message by a newly connected detonator possibly being automatic upon connection or manual by the operator.

In a second configuration, represented in FIG. 2B, the programming console 20 is connected by radiofrequency link, as described hereinafter, to the firing console 10, while the link between the detonators 1 and the firing console 10 is deactivated.

This second configuration corresponds to a second step, during which the cues relating to the programmed firing plan are transferred from the programming console 20 to the firing console 10.

Figure 2B:
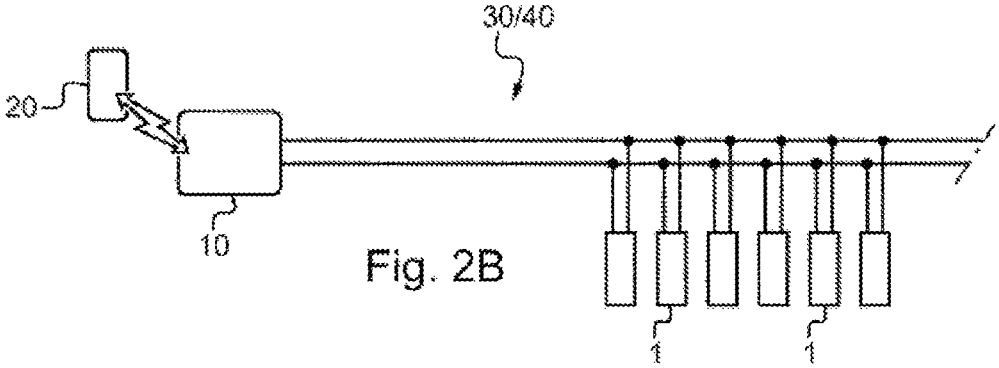
Figure 2C:
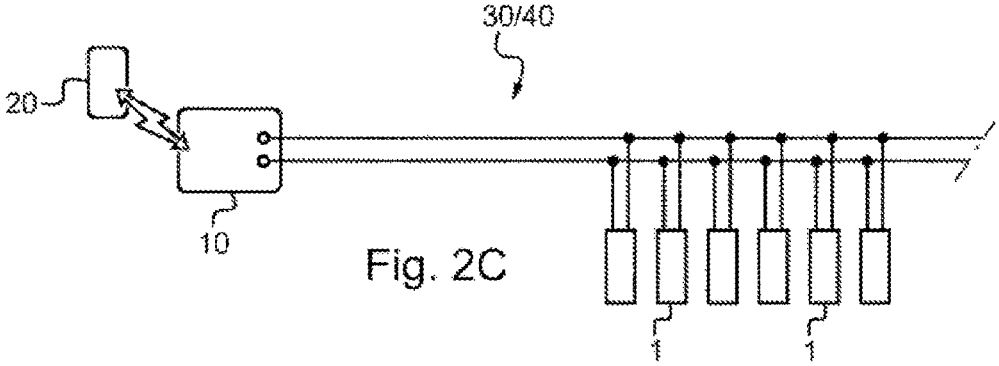

In the third configuration, represented in FIG. 2C, the programming console 20 and the detonators 1 are connected to the firing console 10, the detonators 1 being linked to the firing console 10 by the bus line 30 and the firing line 40. As represented in FIG. 1, the firing set can comprise several lines 30 placed in parallel, thus forming a bifilar network of detonators.

This third configuration corresponds to a third step, during which the firing console 10 is able to communicate with the electronic detonators 1, and then to a final step, during which the firing console 10 can manage a firing procedure and detonation of the detonators 1 connected to the bus lines 30 linked to the firing line 40, in accordance with the envisaged firing plan.

The firing console 10 and the detonators 1 exchange cues by way of coded binary messages, for example in the form of words of a few bytes, on the bifilar firing line 30/40.

The firing console 10 also serves to supply power to the electronic modules of the detonators 1. This power supply constitutes the energy source able to trigger a firing. In this way, the detonators do not exhibit any risk of untimely triggering outside of firing sequences.

In the case of a "master" firing console and of "slave" firing consoles each attached to a firing line 40, it is the slave consoles which communicate, on the one hand, with the detonators 1 via the bifilar network and, on the other hand, with the "master" console by radio.

The firing console 10 and programming console 20 are similar structures and differ mainly by their functionalities, and therefore by the management software ng. In this way, the detonators do not exhibit any risk of untimely triggering outside of firing sequences.

In the case of a "master" firing console and of "slave" firing consoles each attached to a firing line 40, it is the slave consoles which communicate, on the one hand, with the detonators 1 via the bifilar network and, on the other hand, with the "master" console by radio.

The firing console 10 and programming console 20 are similar structures and differ mainly by their functionalities, and therefore by the management software with which they are associated. It is noted that, for safety reasons, only the firing console 10 possesses firing means, in particular software for commanding a firing sequence for the detonators 1 as well as firing codes. These firing codes can for example be presented to the firing console 10 with the aid of a chip card read by a card reader integrated into this console 10.

Figure 3:
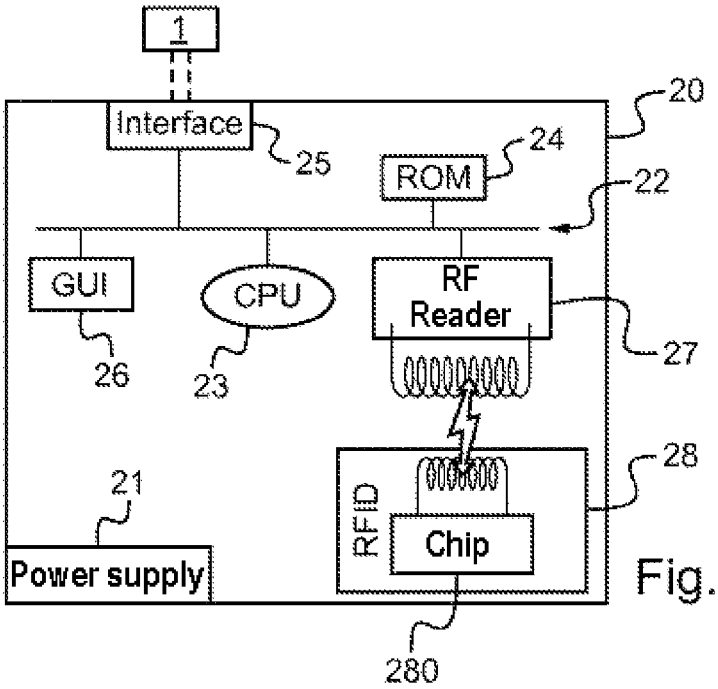
FIG. 3 schematically represents a programming console or unit according to the invention.

As represented schematically in FIG. 3, a programming console 20 is of portable type fitted with an autonomous power supply 21 so as to allow an operator to traverse the site from detonator to detonator, so as in particular to perform the operations of the first step (FIG. 2A).

The console 20 possesses a computerized bus 22 linking a processing processor 23, a read-only memory 24 for storing the software implementing the functions of the console, an input-output interface 25 for connecting the console 20 either directly to a detonator 1, or to the bifilar network 30, a user interface 26 (in particular a viewing screen and an alphanumeric entry keypad) and an RFID reader 27 (radiofrequency identification).

The programming console 20 also comprises an RFID tag 28 fitted with a memory chip 280 able to store data. The expression "RFID tag" is intended to mean the conventional association of an RFID chip with an antenna, the RFID chip being fitted with communication means according to the radiofrequency protocols and with storage capabilities.

An RFID tag 28 with 32 kb of capacity exhibits at one and the same time sufficient capacity for firing plan programming applications according to the invention and a relatively cheap purchase cost.

As a variant, the programming console 20 can comprise several RFID tags 28 accessible by the reader 27 and invoked successively when the memory of the previous tag is fully used. Anti-collision mechanisms, well known to the person skilled in the art, are implemented at the level of this reader to allow the reading of these tags. Thus, the programming capacities of the console 20 are increased without difficulty.

In one embodiment, the RFID tag 28 is mounted on a removable support, for example of chip card format. It can thus be extracted easily so as to be inserted into another programming console or into the firing console, thereby simplifying the transfer of data between the various units.

For the implementation of the invention, the memory chip 280 stores a table FP forming all or part of a firing plan by associating a detonator identifier $ID_{det}$ with a delay corresponding to the firing delay time for the associated detonator. This table may be identified with the aid of a firing plan number optionally associated with an identifier of the firing line or bus lines which will be programmed by this firing plan (for example the identifier of the "slave" firing console attached to the firing line). Thus several tables FP may be stored together in the programming console 20.

Moreover, provision may be made for an identifier $ID_{cons}$ of the RFID tag 28 to be stored in this memory chip so as to make it possible, via the tag 28—console 20 association, to identify the programming console 20 containing the tag. As a variant, this identifier may be replaced with an identifier of the programming console 20 containing this tag.

Examples of functions implemented by the software of the read-only memory 24 are proposed in publication WO 97/45696, in particular the retrieval of the identifier of the detonator 1 connected during the first step illustrated by FIG. 2A.

An additional function for commanding the RF reader 27 is also envisaged. This function exhibits various sub-functions such as a write function, a copy function, a disable function and a conventional read function.

The write function is designed to fill the table FP during the first step of programming the firing plan.

The copy function makes it possible to copy, by reading-writing, the content in memory of an RFID tag present in the reading field of the console 20, to the RFID tag 28 of this same console 20. This function is in particular implemented during the retrieval of a firing plan which is partially elaborated before the failure of the programming console, or during the merger of several partial firing plans on one and the same console 20 with a view to undertaking detonator connection tests.

The disable function makes it possible to deactivate the reader 27 during the intentional transfer of the firing plan to either the firing console 10, or to another programming console 20 before tests for example. This disabling may be triggered by the automatic detection of another radiofrequency field, or manually.

Figure 4:
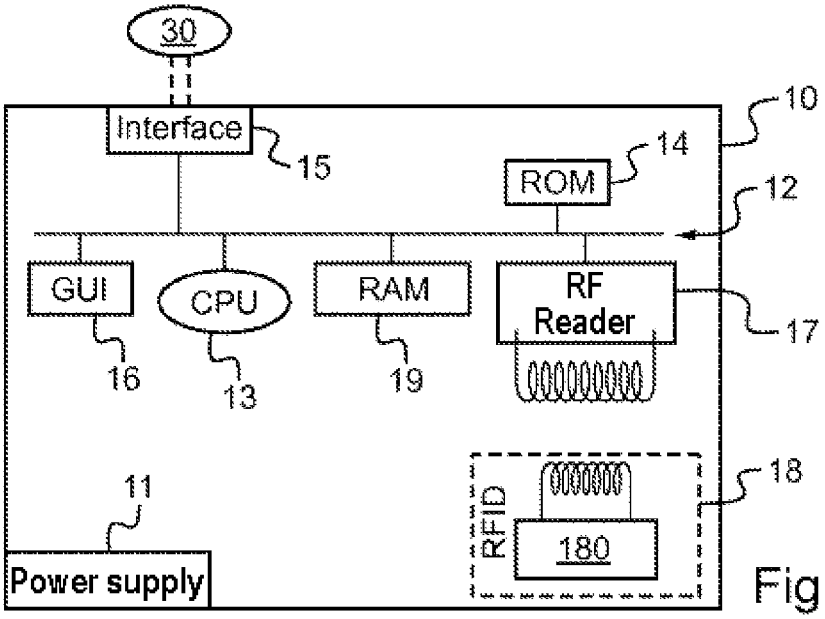
FIG. 4 schematically represents an exemplary firing unit according to the invention.

Such as represented schematically in FIG. 4, the firing console 10 possesses, likewise, an RFID reader 17 able in particular to read the RFID tags 28 of the programming consoles 20 which are presented in its reading field.

The firing console 10 thus exhibits a function for transferring the tables FP stored in the programming consoles 20 by radiofrequency reading. The storage of these transferred tables FP may be effected either in an RFID tag 18 specific to the firing console 10, or, preferably, in a rewritable memory 19, RAM type, of the firing console.

The other functions and interfaces of the firing console 10 are conventional and similar for example to those described in publication WO 97/45696.

Again with reference to FIG. 2A, the first step of programming the detonators 1 is conducted by one or more programming consoles 20. Each console can, for example, initially retrieve the identifier (LTi) of the firing line or of the bus lines that it has to program. Accordingly, the programming console 20 reads an RFID label contained in the "slave" firing console attached to the line or lines to be programmed.

By traversing the site where the detonators are implanted, the operator connects each detonator 1 individually and successively to the programming console 20.

As a variant, the operator can connect the programming console 20 to the bifilar network 30 (or to a part of the latter, for example a firing line) then devoid of the detonators 1. The operator then connects each detonator 1 successively to the network 30.

The connection of a new detonator 1 to the network or to the console 20 is detected by the latter, which automatically retrieves the identification $ID_{det}$ of the detonator, by exchanging messages via the interface 25.

The operator is then invited, via the user interface 26, to associate a delay time $T_{det}$ with the connected detonator. This "programming" can consist in inputting digits into a numerical keypad to specify a delay of between 1 and 16000 milliseconds by coding this delay on 14 bits.

As a variant, the delay times can follow a logical series and the programming console 20 then automatically proposes a delay corresponding to this logical series. The operator then validates the proposed delay or inputs another delay. The implementation of this solution is generally done when it is easy for the operator to traverse the site while following the logical order of firing of the detonators and while programming these detonators successively, so as to exploit to the maximum the delays proposed automatically without manual input.

The programming console 20 then associates, in RFID memory, the chosen delay $T_{det}$ with the selected detonator 1. This association is stored in a look-up table in the memory chip 280. The following table is a simplified exemplary firing plan numbered PT1 for the firing line numbered LT1:

TABLE 1

| firing plan PT1 comprising n detonators PT1 - LT1 | |
|---|---|
| $ID_{det}$ | $T_{det}$ (ms) |
| 1 | 0 |
| 2 | 5 |
| 3 | 25 |
| . . . | |
| n | x |

When several firing plans are stored, the operator indicates furthermore to which firing plan (and therefore table PTi-LTi) the association that was input should be assigned.

In the particular case of FIG. 2A, the programmed detonator 1 is thereafter disconnected from the console 20 and reconnected to the network 30.

These operations are carried out successively for each of the detonators 1 to be programmed, until the complete firing plan is obtained for all the envisaged detonators of the firing line LT1.

It may happen, however, that in the course of this first step, the programming console 20 develops a fault (battery 21 empty) or is damaged by worksite machines whilst the operator is on the site, far from the computer center housing the firing console 10.

Under these conditions, the invention makes it possible to easily retrieve, on site, the firing plan partially created in the programming console and to continue the programming on a backup console without having to reprogram the already processed detonators.

Accordingly, the operator takes a backup programming console 20' identical to the failed console 20. When the failed console is in the RFID reading field of the backup console, the operator selects the FP table copy function proposed by the backup console, by virtue in particular of the identifiers PTi and LTi which make it possible to identify in a definite manner the cues to be retrieved.

The reading and the writing in the RFID tags are then conducted in a conventional way and will not be detailed further here.

As a result, the backup console retrieves the firing plan configuration FP when the first programming console has developed a fault.

The operator can thus carry on with the programming of the other detonators without having lost the work already performed.

The first programming step can terminate with a phase of testing connection of the detonators 1 to the bifilar network. Accordingly, the programming console 20 containing the programmed firing plan is connected to the network. As a variant, the test may be conducted on just one part of the network, for example a single bus line 30.

During this test, the programming console 20 must verify that the set of detonators stored in the table FP is properly connected to the network and that there are no intruder detonators on this network.

In practice for extensive sites, several operators carry out the first step in parallel, with the aid of several programming consoles 20, so as to prepare the firing plan in a shorter time.

In the techniques known from the state of the art, each programming console is then used separately for the test. Each console has a function for counting the number of connected detonators (via a routine for retrieving all the detonators connected at an instant) and a function for verifying the connection of the detonators in memory by dispatching/receiving messages to/from each of these detonators (the console 20 retrieves each stored identifier and queries, by message, the presence on the firing line of the detonator having this identifier). However, the detection of intruders is tricky since, among the detonators not programmed by the present console 20, some are programmed by another programming console. Mental or manual operations are then necessary and laborious.

Within the framework of the present invention, during the test operation, provision is initially made to merge (by concatenation for example) the firing plans of several programming consoles 20 on just one of them, termed the main console. For example, this may be the set of consoles 20 that have programmed one and the same firing line LTi.

In this case, on the basis solely of the routine for retrieving all the connected detonators, the main console can automatically determine the intruder detonators and whether the programmed detonators are indeed all connected.

Starting from the list obtained by the retrieval routine, each of the connected programmed detonators is marked in the table FP (with the aid of a flag for example), and a counter of intruder detonators is incremented. The latter are for example the detonators that have not been programmed, through omission. The entries of the table FP which in the end are unmarked, correspond to the detonators which are poorly hooked up to the network.

It is therefore seen that, through the merger of the firing plans, which is made easy by the RFID tags according to the invention, the test operations are greatly simplified.

To merge the firing plans, the RFID reader 27 of the secondary programming consoles 20 is deactivated, via the disable function, and all or some of these secondary consoles are presented in the RFID reading field of the main console.

The latter, through the copy function detailed hereinabove, transfers the firing plans from each of the secondary consoles to its inherent memory 280, and merges them into a single table FP, having regard to the firing plan number PTi and to the firing line LTi, if any.

The tests can thus be conducted with the aid of a single programming console 20, for the whole of the network, without disconnecting certain detonators.

As a variant, a subpart of the programming consoles can be grouped together depending on the zones of the network, for example the firing lines.

After the set of detonators 1 used in the sequence of the firing plan has been programmed and tested, the programming console 20, preferably the main console grouping together the overall firing plan arising from the merging of the partial firing plans, is brought close to the firing console 10, as represented in FIG. 2B so as to transfer the firing plan.

The RFID reader 27 of the programming console 20 is deactivated through the disable function.

The operator then activates the transfer function of the firing console 10. This activation may be authorized only after introducing an appropriate card containing secret codes. Any other safety facility can also be employed to authorize this activation.

The table FP of the firing plan is then automatically transferred to the firing console 10 by radiofrequency reading by the reader 17. If several RFID tags are accessible, the firing console 10 can invite the operator to select all or some of them and all or some of the tables PTi stored in them, for transfer. The transferred table FP is then stored in RAM memory of the firing console 10.

As a variant, this table may be stored in an RFID tag memory 18 also provided in the firing console 10. This configuration makes it possible to implement a function for copying to a firing backup console if appropriate, in a manner similar to the copy function provided for the programming consoles 20.

Also, if several programming consoles 20 are presented to the firing console 10 for the transfer of parts of the firing plan, the firing console 10 merges the tables FP retrieved so as to form the overall firing plan, taking into account in particular the firing plan number PTi associated with each table FP of the programming consoles.

Once the entire table FP has been transferred into the firing console 10, the firing line 40 linking the firing console 10 to the detonators 1 is activated, as is apparent in FIG. 2C. The firing console 10 can then perform tests prior to the execution of the firing sequence, as described in publication WO 97/45696: automatic test of the modules for igniting the detonators on-line, test of availability of the detonators.

After these tests, the operator gives an arming order with the corresponding button of the firing console 10, and then a firing order with a firing button. This operation causes the firing of each of the detonators with a delay corresponding to that provided in the firing plan FP loaded into memory of the firing console 10. Conventional firing mechanisms may be used, for example those described in the aforementioned publication.

The foregoing examples are merely embodiments of the invention which is not limited thereto.

In particular, described hereinabove was a table FP in memory of the programming consoles 20 which associates a detonator identifier with a delay. However, a pre-firing plan may be envisaged separately, which associates delay times with a set of holes of a site physical configuration. The programming by the programming console 20 can then consist of an association of the detonators 1 with the holes, the table FP in memory then associating a detonator with a hole of the site. In this case, the association of a detonator with a delay is carried out indirectly using the pre-firing plan. Any firing cue, other than a time delay or a hole number, may be associated with a detonator at the level of the programming console, provided that subsequently this cue makes it possible to construct a firing sequence (detonator identifier—firing time delay).

Moreover, the firing console 10 described hereinabove has a structure much like that of the programming consoles 20, comprising in particular a radiofrequency reader and optionally an RFID tag. The invention is however compatible with the already existing firing consoles 10 (with no radiofrequency means). In this case, the programming consoles 20 possess a transfer function similar to that of publication WO 97/45696, for the automatic transfer of the firing plan in memory to the firing console 10 to which they (20) are connected, by infrared or by wire-based link.

This function makes provision however to command the RF reader 27 of the programming console 20 so as to read the table FP in memory and communicate it to the firing console 10 via an appropriate communication interface. This automatic transfer function is implemented by the software stored in read-only memory 24.

The invention claimed is:

1. A system for programming and firing a plurality of electronic detonators that are each associated an inherent identification parameter, the system comprising:

at least one programming unit comprising a memory and configured to determine the identification parameters for electronic detonators and to associate with them individually, in memory, a firing cue, so as to form a firing plan; and a firing unit configured to retrieve, from the memory of the at least one programming unit, said firing plan made of the associations between the identification parameters and the corresponding firing cues, and further configured to command a firing sequence for the detonators on the basis of the firing plan retrieved;

wherein the at least one programming unit further comprises:

a passive tag with radiofrequency reading/writing fitted with a chip operating as memory for the storage of the firing plan, and a radiofrequency reader configured to read and write passive tags, including said passive tag of the programming unit, and wherein one of a first programming unit and the firing unit comprises a radiofrequency reader that reads a firing plan in a memory of a passive tag of a second programming unit and copies said read firing plan into a memory of a passive tag of the first programming unit or into a rewritable memory of the firing unit.

2. The system according to claim 1, wherein said radiofrequency reader of said first programming unit reads the firing plan in memory of the passive tag of the second programming unit and copies said read firing plan into the memory of the passive tag of the first programming unit.

3. The system according to claim 2, wherein said passive tag comprises, associated with said firing plan, an identification datum for a geographical zone to which said detonators forming the firing plan belong.

4. The system according to claim 1, wherein said radiofrequency reader of the firing unit reads and writes the passive tag of the at least one programming unit so as to retrieve said firing plan.

5. The system according to claim 4, wherein said at least one programming unit is configured to disable the radiofrequency reader of the at least one programming unit when an external radiofrequency reader transfers the firing plan from the memory of the programming unit.

6. The system according to claim 1, wherein said firing cues comprise a firing time delay for the corresponding detonator.

7. The system according to claim 1, wherein the passive tag containing the chip is removable.

8. A programming method for the firing of a plurality of electronic detonators with each of which is associated an inherent identification parameter, the method comprising:

a step of determination, by at least one programming unit comprising a memory, of identification parameters of electronic detonators;

a step of association, in memory of the programming unit, of a firing cue with each determined identification parameter, so as to form a firing plan; and a step of acquisition, by a firing unit able to command a firing sequence for the detonators, from the memory of the at least one programming unit, of said firing plan made of the associations between the identification parameters and the corresponding firing cues, wherein the association step comprises a writing by radiofrequency of said association, into the memory of a passive tag with radiofrequency reading/writing, and wherein one of a first programming unit and the firing unit is provided with a radiofrequency reader, said radiofrequency reader reading a firing plan in a memory of a passive tag of a second programming unit and copying said read firing plan into a memory of a passive tag of the first programming unit or into a rewritable memory of the firing unit.

9. The method according to claim 8, wherein the firing plan is read, by radiofrequency reading, from the passive tag of the first programming unit to the memory of the passive tag of the second programming unit.

10. The method according to claim 9, wherein said second programming unit carries on with the acquisition and association steps so as to complete the transferred firing plan.

11. The method according to claim 8, wherein the plurality of electronic detonators is distributed in a plurality of distinct geographical zones, and the method comprising a step of reading and associating an identifier of a so-called geographical zone with said firing plan in memory.

12. The method according to claim 9, wherein the electronic detonators are distributed in a plurality of distinct geographical zones, and the method comprising a step of reading and associating an identifier of a so-called geographical zone with said firing plan in memory.

13. The method according to claim 10, wherein the plurality of electronic detonators is distributed in a plurality of distinct geographical zones, and the method comprising a step of reading and associating an identifier of a so-called geographical zone with said firing plan in memory.

* * * * *